US010012219B2

(12) United States Patent
Bracht et al.

(10) Patent No.: US 10,012,219 B2
(45) Date of Patent: Jul. 3, 2018

(54) HYDROSTATIC VARIABLE DISPLACEMENT AXIAL PISTON MACHINE, IN PARTICULAR HYDROSTATIC VARIABLE DISPLACEMENT AXIAL PISTON MOTOR

(71) Applicant: Robert Bosch GmbH, Stuttgart (DE)

(72) Inventors: Detlef Van Bracht, Horb (DE); Andreas Apperger, Eutingen (DE); Friedemann Nordt, Eutingen (DE)

(73) Assignee: Robert Bosch GmbH, Stuttgart (DE)

( * ) Notice: Subject to any disclaimer, the term of this patent is extended or adjusted under 35 U.S.C. 154(b) by 563 days.

(21) Appl. No.: 14/475,662

(22) Filed: Sep. 3, 2014

(65) Prior Publication Data

US 2015/0068394 A1 Mar. 12, 2015

(30) Foreign Application Priority Data

Sep. 6, 2013 (DE) ..... 10 2013 217 818

(51) Int. Cl.
*F04B 1/32* (2006.01)
*F04B 1/20* (2006.01)

(52) U.S. Cl.
CPC ..... *F04B 1/324* (2013.01); *F04B 1/2078* (2013.01)

(58) Field of Classification Search
CPC ..... F04B 1/13; F04B 1/2078; F04B 1/324
USPC ..... 92/13
See application file for complete search history.

(56) References Cited

U.S. PATENT DOCUMENTS

| | | | | |
|---|---|---|---|---|
| 4,581,980 | A | 4/1986 | Berthold | |
| 5,782,160 | A * | 7/1998 | Boone | F04B 1/324 91/505 |
| 7,975,600 | B2 * | 7/2011 | Beck | F04B 1/126 92/57 |
| 2006/0021339 | A1 * | 2/2006 | Dong | F04B 1/324 60/445 |
| 2006/0123984 | A1 * | 6/2006 | Wanschura | F01B 3/0038 91/505 |
| 2014/0033911 | A1 * | 2/2014 | Rudik | F01B 3/0044 91/499 |

(Continued)

FOREIGN PATENT DOCUMENTS

WO WO2012114589 * 8/2012 ..... F04B 1/22

*Primary Examiner* — F. Daniel Lopez
*Assistant Examiner* — Daniel Collins
(74) *Attorney, Agent, or Firm* — Maginot, Moore & Beck LLP

(57) ABSTRACT

A hydrostatic axial piston machine includes a swashplate with an oblique surface formed thereon. Working pistons, which revolve and are supported by the oblique surface, are axially positioned on the swashplate with respect to a drive shaft. An adjusting cylinder, coupled to the swashplate, is configured to produce a pivoting moment and pivot the swashplate about a pivoting axis. Displacement of the working cylinders per revolution around the drive shaft is adjustable by adjusting a pivoting angle of the oblique surface. The adjustment of the pivoting angle is configured to pass beyond zero degrees, such that the direction of rotation of the drive shaft is changeable. The pivoting axis is at a distance from an axis of rotation of the drive shaft, such that an internal counter pivoting moment counteracting the pivoting moment is produced during operation of the axial piston machine when the working pistons are subjected to pressure.

11 Claims, 4 Drawing Sheets

(56) References Cited

U.S. PATENT DOCUMENTS

2014/0186196 A1* 7/2014 Mizoguchi ..... F03C 1/0671
417/269

* cited by examiner

HYDROSTATIC VARIABLE DISPLACEMENT AXIAL PISTON MACHINE, IN PARTICULAR HYDROSTATIC VARIABLE DISPLACEMENT AXIAL PISTON MOTOR

This application claims priority under 35 U.S.C. § 119 to patent application no. DE 10 2013 217 818.2, filed on Sep. 6, 2013 in Germany, the disclosure of which is incorporated herein by reference in its entirety.

The disclosure relates to a hydrostatic variable displacement axial piston machine, in particular a hydrostatic variable displacement axial piston motor, of swashplate construction in accordance with the present disclosure. In the embodiment as an axial piston motor, an axial piston machine of this kind is also used, in particular, to drive a fan impeller, i.e. as a fan motor. In this case, displacement is the quantity of pressure medium delivered or absorbed for each revolution of a drive shaft.

BACKGROUND

In hydrostatic axial piston machines of this kind, a revolving cylinder drum is provided, in which a plurality of cylinder bores, in each of which a working piston is guided, is arranged in a manner distributed around the circumference. In this arrangement, the cylinder bores and the working pistons extend approximately parallel to a drive shaft of the axial piston machine. Since the piston feet are coupled to a stationary surface, which is set obliquely to the working pistons, a force in the circumferential direction of the cylinder drum is obtained when the working pistons are subjected to pressure (depending on their current pressurization and rotational position on the circumference of the cylinder drum). In operation as a motor, an output torque can thus be taken off at the drive shaft. In operation as a pump, an input torque must be supplied.

In order to the displacement of the hydrostatic axial piston machine, the oblique surface is formed on a swashplate, the pivoting angle of which can be adjusted relative to the longitudinal direction of the working pistons and relative to the axis of rotation of the drive shaft. Because of the pivotability, the swashplate is then also referred to as a pivoting cradle. The pivoting of the pivoting cradle is generally accomplished by means of an adjusting piston, which can engage on the pivoting cradle at a point on the edge of the pivoting cradle remote from the central axis of the drive shaft and from the pivoting axis of the pivoting cradle. To pivot the pivoting cradle back, pressure medium is released from an adjusting chamber on the adjusting piston, enabling a smaller counter piston, which is coupled to the pivoting cradle at an opposite edge section, to act, for example.

The disadvantage with hydrostatic axial piston machines of this kind is the expenditure on equipment for the return motion of the pivoting cradle.

The publication U.S. Pat. No. 4,581,980 shows a hydrostatic axial piston machine having a pivoting cradle, the pivoting angle of which can be adjusted by means of an adjusting piston. The adjusting piston can produce a pivoting moment about the pivoting axis of the pivoting cradle, said pivoting moment acting in the direction of a reduction in the pivoting angle. Opposing this there is a continuous counter pivoting moment or a return pivoting moment applied to the pivoting cradle, said moment being smaller than the pivoting moment that can be applied by the adjusting piston. The counter pivoting moment is produced by arranging the pivoting axis eccentrically with respect to the pivoting cradle, not centrally. The pivoting axis is at a distance from the axis of rotation of the drive shaft and extends in a plane perpendicular to the axis of rotation of the drive shaft. Two circumferential sections of the swashplate of unequal size are defined by the pivoting axis, and therefore there are always more working pistons supported (via the piston feet thereof) on the larger circumferential section of the pivoting cradle than on the remaining, smaller circumferential section. There is therefore a disequilibrium in the sum of the supporting forces, and this acts as an internal counter pivoting moment. Particularly in the case of embodiment as a motor, it is possible to dispense with an additional counter pivoting device in such an axial piston machine since a pressure and hence a counter pivoting moment are built up at the motor through the supply of pressure medium from a pressure medium source, said moment tending to pivot the pivoting cradle in one direction. However, it is also possible for an additional counter pivoting device to be present.

The disadvantage with an axial piston machine of this kind is that, when operated as a pump, it is necessary to reverse the direction of rotation of the drive shaft to reverse the direction of delivery and, when operated as a motor, it is necessary to change the high pressure and low pressure working ports to reverse the direction of rotation of the drive shaft. For the latter case, one known practice in the prior art is to provide a directional control valve which can connect a pressure medium source, e.g. a pump, alternately to one or the other working ports of the motor. The disadvantage of axial piston motors of this kind is the expenditure on equipment involved, resulting from the directional control valve itself and from the two high pressure-proof ports and working lines via which the directional control valve has to be connected to the two working ports.

SUMMARY

Given this situation, it is the underlying object of the disclosure to provide an adjustable hydrostatic axial piston machine having an eccentrically mounted swashplate, the direction of delivery or direction of rotation of which can be reversed by simple means in terms of the equipment involved.

This object is achieved by a hydrostatic axial piston machine according to the present disclosure.

The hydrostatic axial piston machine of swashplate construction according to the present disclosure has a pivoting cradle, on which an oblique surface is formed and to which an adjusting device is coupled. This serves to produce a pivoting moment about a pivoting axis of the pivoting cradle. The working pistons, which are arranged at least approximately axially with respect to a drive shaft, revolve and are supported on the oblique surface of the pivoting cradle. By adjusting the pivoting angle by means of the adjusting device, the pivoting angle of the oblique surface and hence the displacement are modified. Since the pivoting axis is arranged eccentrically with respect to the longitudinal axis of the drive shaft, a return pivoting moment acting counter to the pivoting moment is obtained during use as intended and application of pressure to the axial piston motor according to the disclosure. According to the disclosure, the pivoting cradle can be adjusted through zero, i.e. beyond a position in which the oblique surface is perpendicular to the axis of rotation of the drive shaft. A reversal of the direction of rotation of the drive shaft of an axial piston motor is thus possible in a simple manner since it is not necessary to interchange the high pressure side and the low pressure side. Moreover, no directional control valve is necessary to achieve the reversal in the direction of rotation.

In a preferred embodiment, the adjusting device has a hydrostatic adjusting cylinder, the adjusting piston of which is coupled to the pivoting cradle.

To permit movements of a coupling point between the pivoting cradle and the adjusting device, an adjusting piston rod is, according to a first variant, mounted in an articulated manner in the adjusting piston and in an articulated manner in the pivoting cradle.

If the adjusting piston is formed integrally with an adjusting piston rod, movement of the coupling point is made possible according to a second variant by mounting the adjusting piston in an articulated manner in the adjusting cylinder and the adjusting piston rod in an articulated manner in the pivoting cradle.

In a particularly preferred application of the axial piston machine according to the disclosure, said machine is a fan motor. The drive shaft, which in this case is the output shaft, can then be coupled to a fan impeller. By means of the reversal in the direction of rotation, which is simple to achieve according to the disclosure, it is possible to clear cooling fins. Compared with known solutions, no selector valve is required to reverse the direction of rotation of the fan impeller. A pressure loss at the selector valve is avoided. The change in the direction of rotation takes place smoothly and quickly and not harshly as with a selector valve.

In a development of the axial piston machine according to the disclosure which can be used in a particularly flexible manner, the maximum pivoting angles in both pivoting directions are equal—"pivoting angle +100%/−100%".

To assist the internal counter pivoting moment possible by virtue of the eccentric pivoting axis, a hydrostatic counter piston, which counteracts the adjusting device and the force of which acts in the direction of the counter pivoting moment, can be provided. A pressure chamber on the counter piston can be permanently connected to the high pressure side of the machine, for example, and, at the same time, can be smaller than the adjusting piston of the adjusting device.

To assist the internal counter pivoting moment possible by virtue of the eccentric pivoting axis, it is possible, as an alternative or as a supplementary measure to the hydrostatic counter piston, to provide a spring, which counteracts the adjusting device and the force of which acts in the direction of the counter pivoting moment.

However, these devices counteracting the adjusting device are not necessary in all cases since, by virtue of the eccentrically arranged mounting of the pivoting cradle, an internal counter pivoting moment is produced by the working piston subjected to pressure. Particularly when using an axial piston machine according to the disclosure as a motor, it may be that adjustment of the pivoting cradle in one direction is reliably ensured by the internal counter pivoting moment.

The spring can be coupled directly to the pivoting cradle in a simple manner in terms of the equipment involved. For this purpose, a spring receiver formed as a peg-type projection can be formed on the pivoting cradle.

If the spring is coupled to the pivoting cradle on the same side as the adjusting device in relation to the drive shaft, it can be arranged on a rear side of the pivoting cradle, which faces away from the oblique surface.

In a preferred embodiment, the spring acts indirectly on the pivoting cradle via a mechanical counter piston guided in a counter adjusting cylinder.

In a preferred development, the counter piston has an extension, which can be brought into contact with a bottom of the counter adjusting cylinder. The extension then defines a pivoting angle which determines the maximum displacement of the axial piston machine in one direction. In the case of a motor to which a particular quantity of pressure medium flows, this means a minimum speed of the output shaft. In the case of a fan motor subjected to a particular high pressure, maximum displacement means maximum speed.

In a manner which is simple in terms of the equipment involved, the spring can surround the extension. The spring preferably extends concentrically along the extension.

If the axial piston machine according to the disclosure has a restraining plate, by means of which the piston shoes articulated on the working pistons are held in contact with the oblique surface of the pivoting cradle, an encircling chamfer adjacent to the edge or on the edge of the restraining plate is preferred. The restraining plate can thus be pivoted further without collision in order in this way to achieve a larger displacement volume.

If recesses distributed around the circumference of the restraining plate are provided, into each of which a piston shoe is inserted, it is preferred if the edges of the recesses are designed as collars.

BRIEF DESCRIPTION OF THE DRAWINGS

A number of illustrative embodiments of a hydrostatic axial piston machine according to the disclosure are shown in the drawings. The disclosure is now explained in greater detail with reference to the figures of these drawings, in which.

DETAILED DESCRIPTION

The illustrative embodiments shown of a hydrostatic axial piston machine according to the disclosure are designed primarily for operation as hydraulic motors. However, operation as a pump is not excluded.

Figure 1:
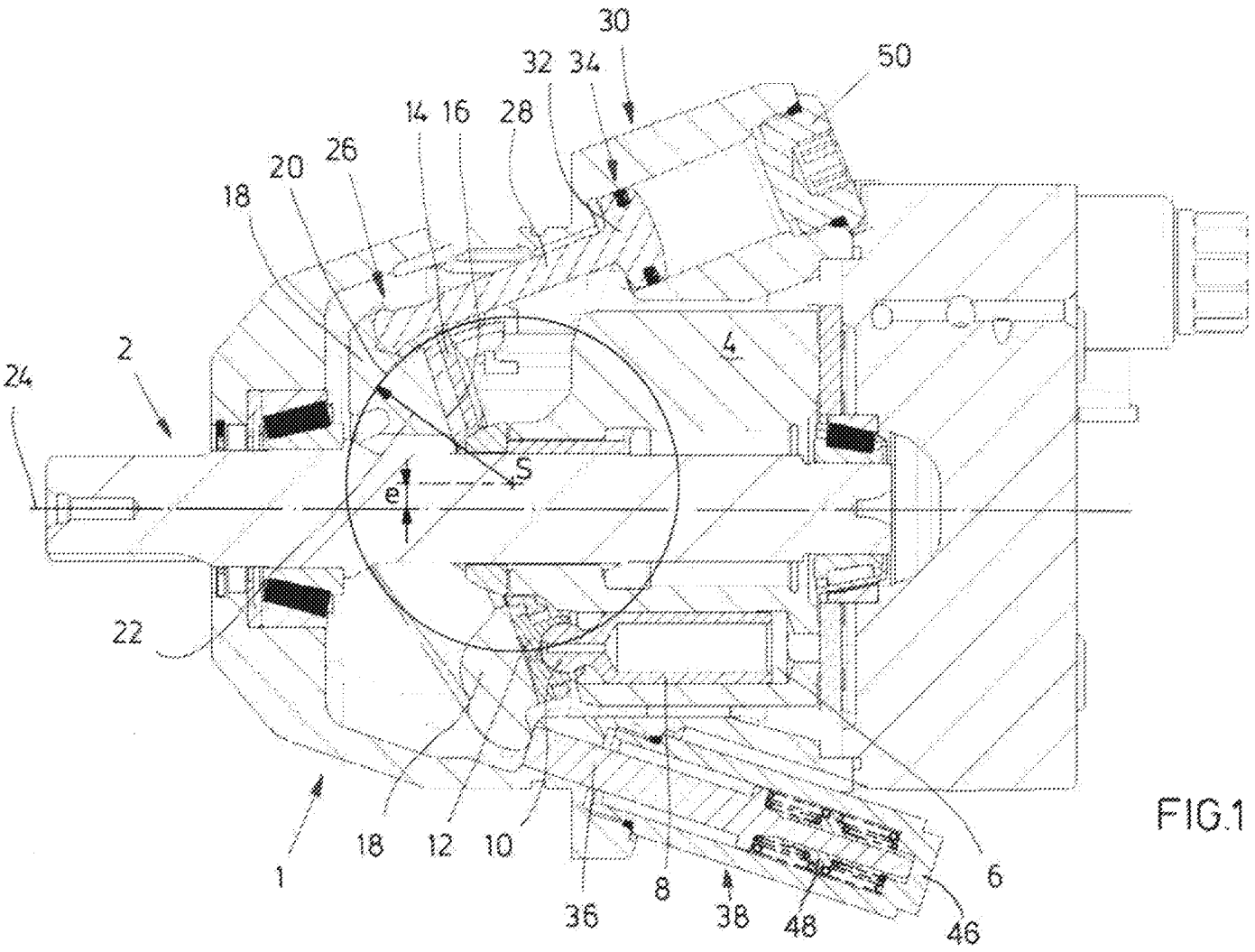
FIG. 1 shows a first illustrative embodiment at a pivoting angle of −100% in a longitudinal section.

FIG. 1 shows a first illustrative embodiment of an axial piston motor according to the disclosure in a longitudinal section. Mounted in the housing 1 thereof is an output shaft 2. This is connected for conjoint rotation to a cylinder drum 4, which surrounds the output shaft 2 in a rotationally symmetrical manner. A plurality of working cylinders is provided uniformly on the circumference of the cylinder drum 4, of which only one working cylinder 6 is illustrated in FIG. 1. Guided in each working cylinder 6 is a working piston 8, which is articulated on a respective sliding shoe 12 via a respective piston foot 10. The sliding shoes 12 are held against an oblique surface 16 by means of a restraining plate 14, which is explained in greater detail with reference to FIGS. 3 and 4. The oblique surface 16 is formed on a pivoting cradle 18, which is mounted in the housing 1 by means of a pivot bearing. The pivot bearing is symbolized by a circle 20, and the radius of the pivot bearing is symbolized by an arrow 22. The oblique surface 16 can thus be pivoted with the pivoting cradle 18 about a pivoting axis S, which is arranged perpendicularly to the section plane and hence to the plane of the drawing of FIG. 1. The pivoting axis S has an eccentricity or a distance e from the axis of rotation 24 of the output shaft 2, on the one hand, and from a center line (not shown specifically) of the oblique surface 16, on the other. The center line extends parallel to the pivoting axis S. The pivoting axis S is furthermore situated in a plane perpendicular to the axis of rotation 24.

An adjusting piston rod 28 of an adjusting cylinder 30 is articulated to the pivoting cradle 18 via a ball joint 26 on the same side of the axis of rotation 24 as that on which the pivoting axis S is also situated (the upper side in FIG. 1). Formed integrally on the adjusting piston rod 28 is an adjusting piston 32, which is guided in the adjusting cylinder 30 by means of a mechanical seal 34. The mechanical seal is advantageously preloaded outward with a radial force. As a result and owing to a spherical shaping of the adjusting piston 32, slight tilting of the adjusting piston rod 28 with the adjusting piston 32 occurring during the pivoting of the pivoting cradle 18 can be tolerated. By means of the mechanical seal 34, the leakage from the adjusting chamber behind the adjusting piston 32 into the interior of the housing is kept small.

In the operating state shown in FIG. 1, the pivoting cradle 18 has been pivoted out to the maximum extent in one direction from a neutral or zero position, in which the oblique surface 16 is perpendicular to the axis of rotation 14. For this purpose, the adjusting piston rod 28 and adjusting piston have been extended to the maximum extent. Normally, pivoting out in this direction is referred to as negative, and therefore the pivoting cradle assumes the maximum negative pivoting angle (−100%) in FIG. 1.

On the opposite side of the axial piston motor (at the bottom in FIG. 1) in relation to the axis of rotation 24, a counter piston 36 of a counter cylinder 38 is in contact with the pivoting cradle 18. At the maximum pivoting angle of the pivoting cradle 18 shown in FIG. 1, the counter piston 36 has been pushed back and retracted to the maximum extent by the adjusting piston 32. The adjusting piston 30 and the counter cylinder 38 are set at an oblique angle to the longitudinal axis 24.

To pivot the pivoting cradle 18 back to 0° (vertical in FIG. 1) or to pivot the pivoting cradle 18 through to a positive pivoting angle, pressure medium is released from the adjusting cylinder 30.

Figure 2:
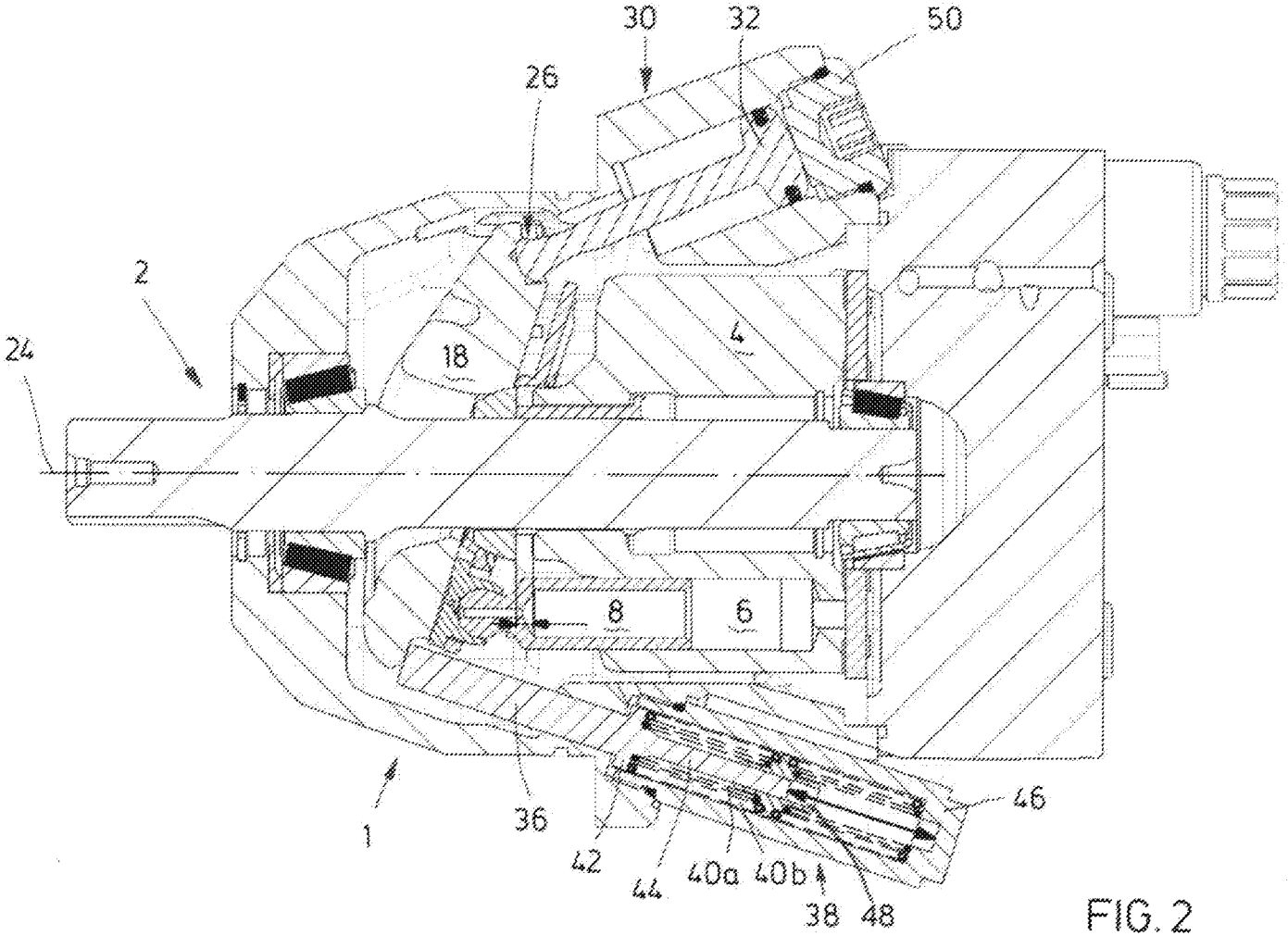
FIG. 2 shows the illustrative embodiment according to FIG. 1 in a longitudinal section at a pivoting angle of +100%.

FIG. 2 shows the axial piston motor according to FIG. 1 in an operating state in which the pivoting cradle 18 has been pivoted through relative to FIG. 1, with the result that the pivoting angle is +100%. For this purpose, pressure medium has been released from the adjusting cylinder 30. Owing to the eccentric mounting, the pivoting cradle has been pivoted from the position shown in FIG. 1 into the position shown in FIG. 2 via the zero position under the action of the forces in the driving mechanism, wherein the forces in the driving mechanism are assisted via the counter piston 36 by the two relaxing springs 40*a* and 40*b*, which are arranged concentrically with one another.

The counter piston 36 has a radial collar 42, on which the springs 40*a* and 40*b* rest. The counter piston 36 is guided in the housing 1. An extension 44 extends in the direction of a cylinder bottom 46 on the side of the radial collar 42 facing away from the pivoting cradle 18. An intermediate spring plate 48 is guided on the extension 44. The two springs 40*a* and 40*b* are clamped between the radial collar 42 and the intermediate spring plate 48, which, in turn, is supported on the cylinder bottom 46 by two further springs, which are similar to springs 40*a* and 40*b*. The maximum negative pivoting angle is determined by abutments of the extension 44 on the cylinder bottom 46, as is apparent from FIG. 1. If the maximum negative value of the pivoting angle is to be variable, the cylinder bottom can be provided with an internal thread, making it possible to screw in an adjusting screw, against which the extension 44 strikes.

The two springs 40*a*, 40*b* are accommodated concentrically with the extension 44 and concentrically with one another in the counter cylinder 38. In the operating state shown in FIG. 2, the two springs 40*a*, 40*b* are relaxed to the maximum extent and the return piston 36 is extended to the maximum extent, while the adjusting piston 32 of the adjusting cylinder 30 rests on a cap 50 screwed into said cylinder.

Owing to the eccentric mounting of the pivoting cradle 18, more working pistons 8 are supported continuously on the side of the oblique surface 16 which lies on the same side as the counter cylinder 38. As a result, there is a further counter adjusting moment in addition to the force of the counter cylinder 38 or of the springs 40*a*, 40*b* thereof, said counter adjusting moment being the product of the distance e of the pivoting axis S from the axis of rotation 24 and the working pressure. At normal working pressures of 50 to 250 bar, the further counter adjusting moment is significantly greater than the moment produced by the springs.

Figure 3:
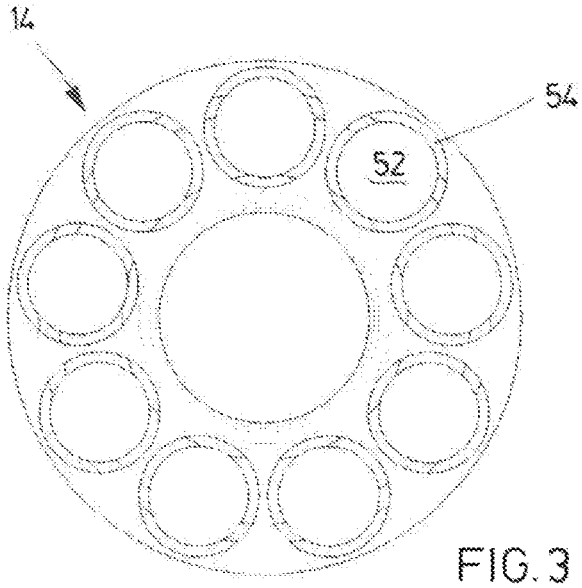
FIG. 3 shows a restraining plate of the first illustrative embodiment in elevation.

FIG. 3 shows the restraining plate 14 of the first illustrative embodiment in accordance with the two preceding figures. It has recesses 52 distributed uniformly over the circumference, into each of which a sliding shoe 12 is inserted. In this case, there is an encircling collar 53 formed at the edge of each recess 52.

Figure 4:
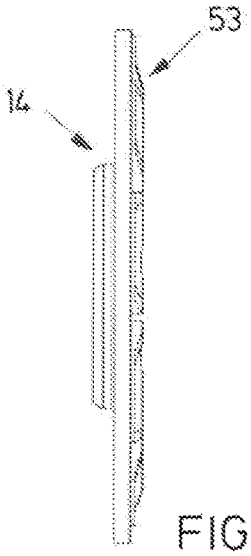
FIG. 4 shows the restraining plate according to FIG. 3 in a side view.

FIG. 4 shows the restraining plate 14 according to FIG. 3 in a side view. An encircling chamfer 54 is formed on an outer edge of the restraining plate 14 in order in this way to create space for the two maximum pivoting angles (+100% and −100%) relative to the cylinder drum 4 (cf FIG. 1 or 2).

Figure 5:
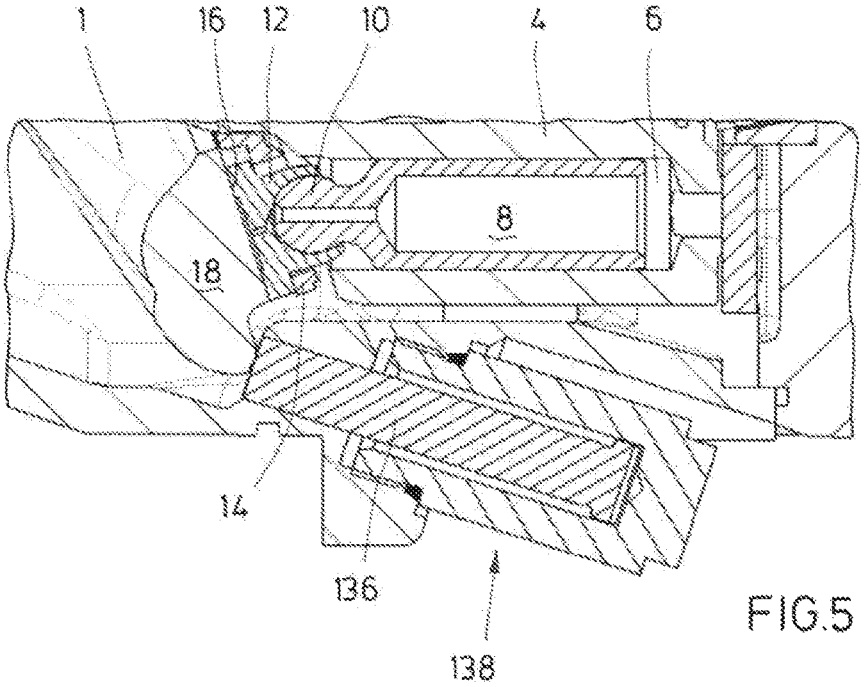
FIG. 5 shows a detail of a second illustrative embodiment.

FIG. 5 shows a detail of a second illustrative embodiment of an axial piston motor according to the disclosure. Here, a further embodiment of a hydrostatic counter cylinder 138 with a corresponding hydrostatic counter piston 136 is shown. This has no extension and is retracted to the maximum extent into the cylinder 138 at the illustrated pivoting angle of −100%, while the adjusting piston (not shown) is extended to the maximum extent.

As in the preceding illustrative embodiment, the counter piston 136 has a contact surface at the end, which rests on a spherical contact on the edge of the pivoting cradle 18. It is thus possible for the two contacts to slide (within narrow limits) transversely to the direction of motion of the counter piston 136 during pivoting of the pivoting cradle 18.

Figure 6:
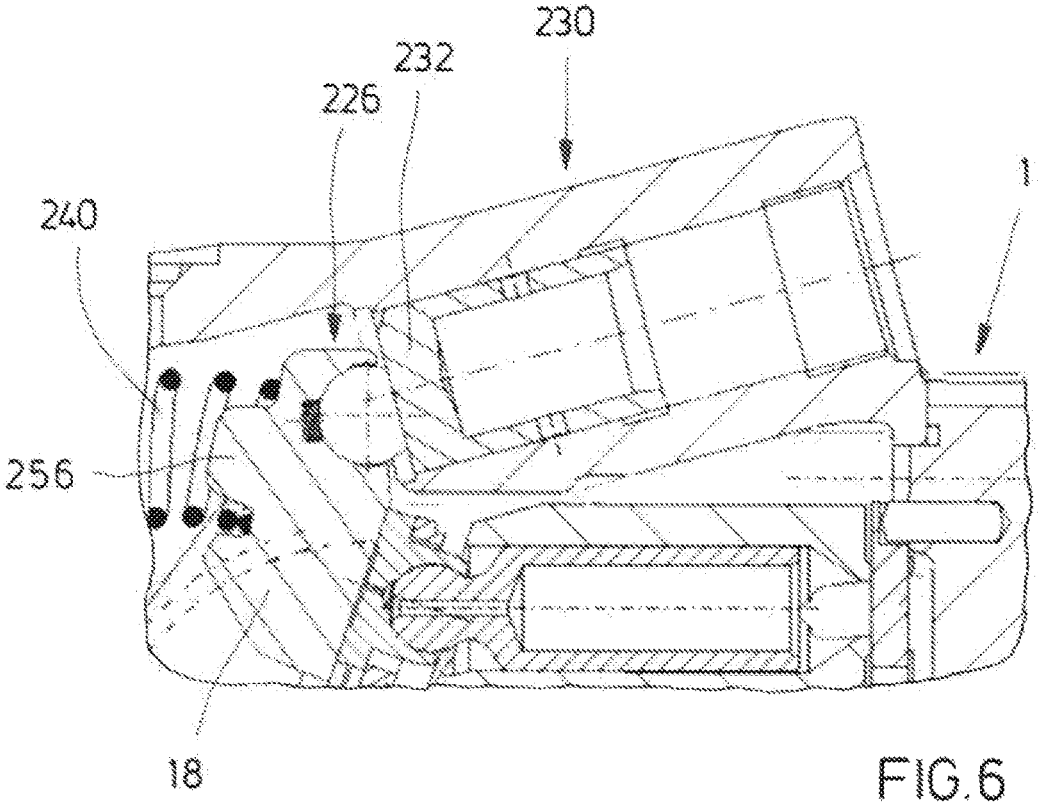
FIG. 6 shows a detail of a third illustrative embodiment.

FIG. 6 shows a detail of a third illustrative embodiment of an axial piston motor according to the disclosure. An adjusting piston 232 designed as a hollow piston is guided in the adjusting cylinder 230 inserted into the housing 1, said piston being coupled to the pivoting cradle 18 by a ball joint 226. A spring 240 acting as a counter spring is provided on the pivoting cradle 18 on the same side of the axial piston motor in relation to the axis of rotation 24 (not shown in FIG. 6). In FIG. 6, said spring is supported on the left on the housing 1 and pushes the pivoting cradle 18 in the direction of the counter pivoting moment. To receive and fix the end section of the spring 240 on the pivoting cradle side, the pivoting cradle 18 has a peg-type projection 256 on its rear side.

Figure 7:
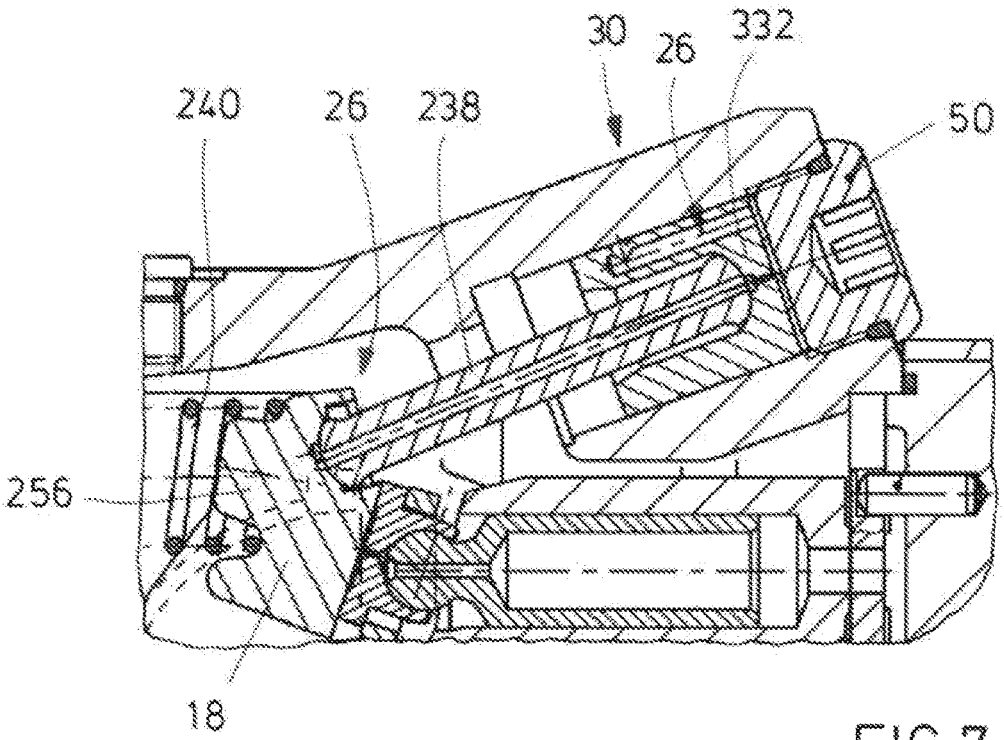
FIG. 7 shows a detail of a fourth illustrative embodiment.

FIG. 7 shows a detail of a fourth illustrative embodiment of an axial piston motor according to the disclosure. Here, the spring 240 and the projection 256 correspond to those in the third illustrative embodiment shown in FIG. 6. The adjusting cylinder 30 with the cap 50 corresponds to that in the first illustrative embodiment shown in FIGS. 1 and 2. As a departure from the first illustrative embodiment, the adjusting piston rod 328 and the adjusting piston 332 are not of integral design but are coupled to one another by a ball joint 26, which corresponds approximately to the ball joint 26 between the adjusting piston rod 328 and the pivoting cradle 18 for instance. No tilting of the adjusting piston 332 in the adjusting cylinder 30 is therefore necessary.

A disclosure is made of a hydrostatic axial piston machine having a swashplate, on which an oblique surface is formed, on which working pistons arranged at least approximately axially with respect to a drive shaft revolve and are supported. To produce a pivoting moment and to pivot the swashplate about a pivoting axis, an adjusting piston of an adjusting cylinder is coupled to the swashplate. By adjusting the pivoting angle of the oblique surface, the displacement of the machine per revolution around the drive shaft is adjusted. The adjustment of the pivoting angle can pass via a zero position, in which the oblique surface is perpendicular to the axis of rotation of the drive shaft, thus allowing the direction of rotation of the drive shaft or the direction of delivery to be changed in a simple manner. Since the pivoting axis is arranged at a distance from the axis of rotation of a drive shaft, a counter pivoting moment counteracting the pivoting moment is produced during the operation of the axial piston machine when the working pistons are subjected to pressure.

LIST OF REFERENCE SIGNS

1 housing
2 drive shaft
4 cylinder drum
6 working cylinder
8 working piston
10 piston foot
12 sliding shoe
14 restraining plate
16 oblique surface
18 pivoting cradle
20 circle
22 arrow
24 axis of rotation
26 ball joint
28 adjusting piston rod
30 adjusting cylinder
32 adjusting piston
34 mechanical seal
36 counter piston
38 counter cylinder
40*a* spring
40*b* spring
42 radial collar
44 extension
46 cylinder bottom
48 intermediate spring plate
52 recess
53 collar
54 chamfer
136 counter piston
138 counter cylinder
226 ball joint
230 adjusting cylinder
232 adjusting piston
240 spring
256 projection
328 adjusting piston rod
332 adjusting piston
S pivoting axis
e distance

What is claimed is:

1. A hydrostatic axial piston machine, comprising:

a drive shaft configured to rotate about a rotation axis;

a pivoting cradle;

an adjustment device coupled to the pivoting cradle and configured to produce a pivoting moment that pivots the pivoting cradle about a pivoting axis in a first direction, wherein the pivoting cradle is configured to be pivoted from positive pivoting angles to negative pivoting angles through a pivoting angle of 0 degrees, the adjustment device including an adjusting piston positioned at least partially within an adjusting cylinder;

a spring configured to bias the adjustment piston in a direction into the adjusting cylinder; and a cylinder drum configured to:

revolve with the drive shaft such that the cylinder drum is secured against twisting; and guide working pistons supported on the pivoting cradle;

wherein the pivoting axis is located at a distance from the rotation axis, such that a counter pivoting movement on the pivoting cradle is produced via support of the working pistons, and wherein a side of the pivoting cradle facing the cylinder drum defines a plane and the pivoting axis is between the plane and the cylinder drum.

2. The hydrostatic axial piston machine according to claim 1, wherein the adjusting piston is coupled to the pivoting cradle by a ball joint.

3. The hydrostatic axial piston machine according to claim 1, wherein:

the adjusting piston is formed integrally with an adjusting piston rod;

the adjusting piston is mounted in an articulated configuration in the adjusting cylinder; and the adjustment piston rod is mounted in an articulated configuration on the pivoting cradle.

4. The hydrostatic axial piston machine according to claim 1, wherein the hydrostatic axial piston machine is a fan motor.

5. The hydrostatic axial piston machine according to claim 1, wherein a maximum positive pivoting angle from the pivoting angle of 0 degrees is equal in magnitude to a maximum negative pivoting angle from the pivoting angle of 0 degrees.

6. The hydrostatic axial piston machine according to claim 2, wherein the spring is configured to act indirectly on the pivoting cradle via a counter piston that enters a hydrostatic counter cylinder.

7. The hydrostatic axial piston machine according to claim 6, wherein:

the counter piston has an extension configured to come into contact with a bottom of the counter cylinder; and the spring surrounds the extension.

8. The hydrostatic axial piston machine according to claim 1, further comprising a restraining plate configured to hold sliding shoes articulated on the working pistons in contact with an oblique surface of the pivoting cradle, wherein each sliding shoe is encircled by a respective collar located adjacent to or on the edge of the restraining plate.

9. The hydrostatic axial piston machine according to claim 8, wherein the restraining plate includes recesses distributed around a circumference of the restraining plate;

the recesses are configured to hold the sliding shoes in contact with the oblique surface; and edges of the recesses are configured as the respective collars.

10. A hydrostatic axial piston machine, comprising:

a drive shaft configured to rotate about a rotation axis;

a pivoting cradle;

an adjustment device including an adjusting cylinder and an adjusting piston mounted in a tiltable and slidable configuration in the adjusting cylinder and formed integrally with an adjusting piston rod, the adjusting piston mounted in an articulated configuration on the pivoting cradle and configured to produce a pivoting moment that pivots the pivoting cradle about a pivoting axis in a first direction, wherein the pivoting cradle is configured to be pivoted from positive pivoting angles to negative pivoting angles through a pivoting angle of 0 degrees; and a cylinder drum configured to:

revolve with the drive shaft such that the cylinder drum is secured against twisting; and guide working pistons supported on the pivoting cradle;

wherein the pivoting axis is located at a distance from the rotation axis, such that a counter pivoting movement on the pivoting cradle is produced via support of the working pistons, and wherein a side of the pivoting cradle facing the cylinder drum defines a plane and the pivoting axis is between the plane and the cylinder drum.

11. A hydrostatic axial piston machine, comprising:

a drive shaft configured to rotate about a rotation axis;

a pivoting cradle;

an adjustment device coupled to the pivoting cradle and configured to produce a pivoting moment that pivots the pivoting cradle about a pivoting axis in a first direction, wherein the pivoting cradle is configured to be pivoted from positive pivoting angles to negative pivoting angles through a pivoting angle of 0 degrees;

a cylinder drum configured to:

revolve with the drive shaft such that the cylinder drum is secured against twisting; and guide working pistons supported on the pivoting cradle;

wherein the pivoting axis is located at a distance from the rotation axis, such that a counter pivoting movement on the pivoting cradle is produced via support of the working pistons; and a restraining plate configured to hold sliding shoes articulated on the working pistons in contact with an oblique surface of the pivoting cradle, wherein each sliding shoe is encircled by a respective collar having an outer chamfer portion proximate an outer edge of the restraining plate and an inner chamfer portion located radially inwardly from the outer chamfer portion, a first end of the inner chamfer portion separated from a first end of the outer chamfer portion by a first planar portion of the collar, and a second end of the inner chamfer portion separated from a second end of the outer chamfer portion by a second planar portion of the collar.

* * * * *